US009324273B2

(12) United States Patent
Ryu

(10) Patent No.: US 9,324,273 B2
(45) Date of Patent: Apr. 26, 2016

(54) ORGANIC LIGHT EMITTING DISPLAY AND METHOD OF DRIVING THE SAME

(75) Inventor: Jae-Woo Ryu, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 500 days.

(21) Appl. No.: 13/563,636

(22) Filed: Jul. 31, 2012

(65) Prior Publication Data

US 2013/0194245 A1 Aug. 1, 2013

(30) Foreign Application Priority Data

Jan. 26, 2012 (KR) ..... 10-2012-0007949

(51) Int. Cl.
*G09G 3/30* (2006.01)
*G09G 3/32* (2006.01)

(52) U.S. Cl.
CPC ..... *G09G 3/3275* (2013.01); *G09G 2310/0251* (2013.01); *G09G 2320/0252* (2013.01)

(58) Field of Classification Search
CPC ..... G09G 2310/0291; G09G 2310/0248; G09G 2310/0251; G09G 2340/16; G09G 3/30; G09G 3/231; G09G 3/0248
USPC ..... 315/169.3; 327/108, 109; 345/76–83, 345/211–214
See application file for complete search history.

(56) References Cited

U.S. PATENT DOCUMENTS 7,761,120 B2 * 7/2010 Tsuchi et al. ..... 455/566
8,194,009 B2 * 6/2012 Iwabuchi ..... 345/77
8,363,071 B2 * 1/2013 Kondo et al. ..... 345/691
8,466,868 B2 * 6/2013 Lee et al. ..... 345/100
2001/0050411 A1 * 12/2001 Gotoh et al. ..... 257/545
2007/0001941 A1 * 1/2007 Umezaki et al. ..... 345/77
2007/0115243 A1 5/2007 Kim et al.
2007/0279371 A1 * 12/2007 Lee et al. ..... 345/102
2010/0123654 A1 * 5/2010 Kimura ..... 345/92
2011/0133780 A1 * 6/2011 Shau ..... 326/87
2012/0026152 A1 * 2/2012 Chung ..... 345/212
2012/0032944 A1 * 2/2012 Kojima ..... 345/212
2012/0280959 A1 * 11/2012 Shiu et al. ..... 345/211

FOREIGN PATENT DOCUMENTS

KR 10-2007-0053469 5/2007
KR 10-2009-0099836 A 9/2009

* cited by examiner

*Primary Examiner* — Amr Awad
*Assistant Examiner* — Aaron Midkiff
(74) *Attorney, Agent, or Firm* — Lewis Roca Rothgerber Christie LLP

(57) ABSTRACT

An organic light emitting display capable of improving data charging time, includes pixels at crossing regions between scan and data lines and configured to control an amount of current supplied from a first to a second power source, a charge unit adjacent to an adjacent pixel of the pixels and coupled to the same data line as the adjacent pixel, a scan driver for supplying scan signals to the scan lines, a data driver for supplying data signals to the data lines in synchronization with the scan signals, and a comparison unit in a channel of the data driver to compare a data signal supplied to a current line with a data signal supplied to a previous line and to control coupling between the charge unit and the data line according to a comparison result in a partial period of a period in which the scan signals are supplied.

17 Claims, 4 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2012-0007949, filed on Jan. 26, 2012, in the Korean Intellectual Property Office, the entire content of which is incorporated herein by reference.

BACKGROUND

1. Field

The present invention relates to an organic light emitting display and a method of driving the same.

2. Description of the Related Art

Recently, various flat panel displays (FPDs) having reduced weight and volume in comparison to cathode ray tubes (CRTs) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLEDs) that generate light by re-combination of electrons and holes. The organic light emitting display has high response speed and is driven with low power consumption.

The organic light emitting display includes a plurality of pixels arranged at crossing regions of a plurality of data lines, scan lines, and power source lines in a matrix. Each of the pixels typically includes an organic light emitting diode (OLED), at least two transistors including a driving transistor, and at least one capacitor.

Recently, an organic light emitting display having a large panel size, a high resolution and/or a high driving frequency, is being developed. However, when the organic light emitting display has a large panel size, a high resolution, and/or a high driving frequency, the data charging time of each of the pixels may be reduced so that an image of desired brightness may not be displayed.

SUMMARY

Accordingly, according to embodiments of the present invention, an organic light emitting display capable of improving data charging time and a method of driving the same, are provided.

In order to achieve the foregoing and/or other aspects of embodiments according to the present invention, there is provided an organic light emitting display, including pixels formed at crossing regions between scan lines and data lines, and configured to control an amount of current supplied from a first power source to a second power source, a charge unit adjacent to an adjacent pixel of the pixels and coupled to a same one of the data lines as the adjacent pixel, a scan driver for supplying scan signals to the scan lines, a data driver for supplying data signals to the data lines in synchronization with the scan signals, and a comparison unit in a corresponding one of channels of the data driver, and configured to compare a current data signal of the data signals with a previous data signal of the data signals, and to control coupling between the charge unit and the data line in accordance with a comparison result in a partial period of a period in which a corresponding one of the scan signals is supplied.

The comparison unit may compare previous data corresponding to the previous data signal with current data corresponding to the current data signal. The comparison unit may include a comparator for comparing the previous data with the current data and for outputting a first voltage or a second voltage to a first output terminal in accordance with a comparison result, a selection unit coupled to the first output terminal, and an inverter coupled between the selection unit and a second output terminal. The comparator may supply a first control signal to the selection unit in a period where a same voltage is supplied to the first output terminal and the second output terminal. The selection unit may electrically couple the first output terminal to the second output terminal when the first control signal is supplied, and may electrically couple the first output terminal to the inverter when the first control signal is not supplied. The comparator may generate the first control signal in a remaining period other than the partial period and when the previous data is the same as the current data.

The comparator may output the first voltage to the first output terminal when it is determined that the current data has a higher gray level than the previous data and may output the second voltage to the first output terminal when it is determined that the current data is the same as the previous data or has a lower gray level than the previous data. The first voltage may be supplied to the first output terminal or the second output terminal in the partial period. The comparison unit may further include a delay unit for delaying the current data by one horizontal period to supply the delayed current data to the comparator as the previous data. The charge unit may include a first resistor, a first transistor, a second transistor, and a second resistor serially coupled between a third power source and a fourth power source that has a lower voltage level than the third power source. A common terminal of the first transistor and the second transistor may be coupled to a corresponding one of the data lines.

The first transistor may be coupled to the first output terminal to be turned on when the first voltage is supplied and may be turned off when the second voltage is supplied. The second transistor may be coupled to the second output terminal to be turned on when the first voltage is supplied and may be turned off when the second voltage is supplied. The third power source may have a higher voltage level than the data signal and the fourth power source may have a lower voltage level than the data signal. The third power source may have the same voltage level as the first power source. The fourth power source may have the same voltage level as the second power source.

In another embodiment according to the present invention, a method of driving an organic light emitting display is provided. The method includes sequentially supplying scan signals to scan lines, supplying data signals to data lines in synchronization with the scan signals, comparing previous data corresponding to a previous data signal supplied to a corresponding one of the data lines from among the data signals with current data corresponding to a current data signal supplied to the corresponding one of the data lines from among the data signals, and controlling coupling between each of the data lines and a first power source or a second power source lower than the first power source in a partial period of a period in which a corresponding one of the scan signals is supplied using a plurality of charge units coupled to respective ones of the data lines in accordance with the comparison result.

The first power source may have a higher voltage level than the data signal and the second power source may have a lower voltage level than the data signal. The first power source may be coupled to a corresponding one of the data lines when the current data has a higher gray level value than the previous data. The second power source may be coupled to the corresponding one of the data lines when the current data has a lower gray level value than the previous data. The first power source and the second power source may not be coupled to the data line when the current data is the same as the previous data.

In the organic light emitting display according to embodiments of the present invention and the method of driving the same, in a period where the scan signals are supplied, an additional voltage other than the data signals may be supplied to the pixels so that the data signals may be charged or discharged within a desired time.

BRIEF DESCRIPTION OF THE DRAWINGS

The accompanying drawings, together with the specification, illustrate exemplary embodiments of the present invention, and, together with the description, serve to explain the principles of embodiments according to the present invention.

DETAILED DESCRIPTION

Figure 1:
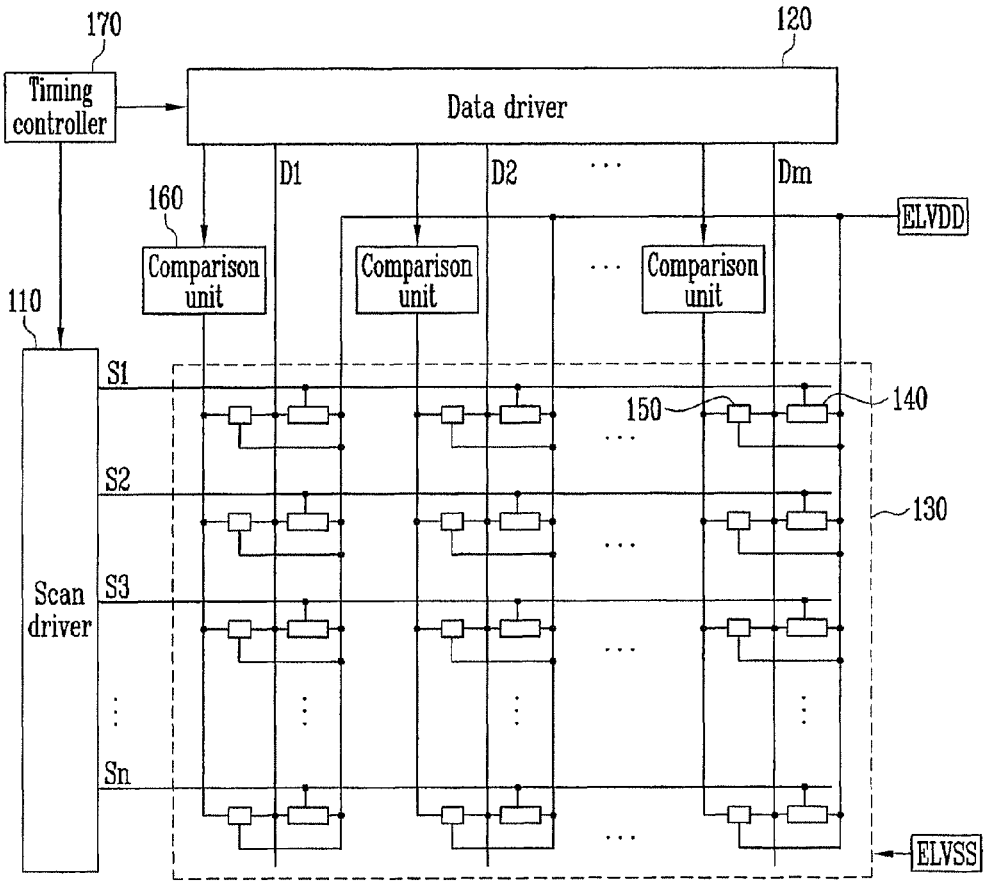
FIG. 1 is a diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention may have been omitted for clarity. Also, like reference numerals refer to like elements throughout.

Hereinafter, an organic light emitting display according to embodiments of the present invention and a method of driving the same will be described in detail as follows with reference to FIGS. 1 to 6 in which example embodiments by which those who skilled in the art may perform the present invention are included.

FIG. 1 is a diagram illustrating an organic light emitting display according to an embodiment of the present invention.

Referring to FIG. 1, an organic light emitting display according to an embodiment of the present invention includes a display unit 130 including pixels 140 positioned at crossing regions of scan lines S1 to Sn and data lines D1 to Dm, a scan driver 110 for driving the scan lines S1 to Sn, a data driver 120 for driving the data lines D1 to Dm, and a timing controller 170 for controlling the scan driver 110 and the data driver 120.

In addition, the organic light emitting display according to the described embodiment of the present invention includes comparison units 160 provided in respective channels of the data driver 120 to compare previous data (previous line data or data supplied to the channel in a previous scan period) with current data (current line data or data supplied to the channel in a current scan period) and charge units 150 adjacent to the pixel units 140 and each coupled to the same data line (one of D1 to Dm) as an adjacent pixel 140.

The scan driver 110 sequentially supplies scan signals to the scan lines S1 to Sn. When the scan signals are sequentially supplied to the scan lines S1 to Sn, the pixels 140 are selected in units of lines (e.g., horizontal row-by-row).

The data driver 120 supplies data signals to the data lines D1 to Dm in synchronization with the scan signals. The data signals supplied to the data lines D1 to Dm are supplied to the pixels 140 selected by the scan signals.

The pixels 140 are selected when the scan signals are supplied to charge the voltages corresponding to the data signals. The pixels 140 that charge the voltages corresponding to the data signals generate light components (e.g., light components having predetermined brightness components) corresponding to the data signals.

The comparison units 160 are formed in the respective channels of the data driver 120. Each of the comparison units 160 compares the data of a previous data signal with the data of a current data signal and controls the charge units 150 in accordance with the comparison result.

For example, the data signals are sequentially supplied horizontal line-by-line (e.g., row-by-row) to the respective channels of the data driver 120, that is, the data lines D1 to Dm, in synchronization with the scan signals. Each of the comparison units 160 compares the data of a previous data signal and the data of a current data signal that are supplied to the channel to which the comparison unit 160 is coupled. In one embodiment, when the data of the current data signal has a high gray level, the comparison unit 160 controls the charge units 150 coupled to the comparison unit 160 so that a higher voltage than a data signal is supplied to the data line (one of D1 to Dm) coupled to the same channel as the comparison unit 160 in a partial period of the period in which the scan signals are supplied. In addition, when the data of the current data signal has a low gray level, the comparison unit 160 controls the charge units 150 coupled thereto so that a lower voltage than a data signal is supplied to the data line (one of D1 to Dm) coupled to the same channel as the comparison unit 160 in a partial period of the period in which the scan signals are supplied. However, the present invention is not limited thereto. In other embodiments, depending on the circuit configuration such as, for example, the types of transistors used in the pixels, a lower voltage may be provided when the current data signal has a high gray level, and a higher voltage may be provided when the current data signal has a low gray level.

In the above described example, the comparison unit 160 outputs the comparison result using previous data and current data. However, the present invention is not limited to the above. For example, the comparison unit 160 may directly compare the data signal supplied to the previous data line with the data signal supplied to the current data line. In this case, each of the comparison units 160 may be electrically coupled to the data line (one of D1 to Dm) positioned in the same channel as the comparison unit 160.

The charge units 150 are located adjacent to the pixels 140. The charge units 150 are coupled to the same data lines D1 to Dm as the adjacent pixels 140. Each of the charge units 150 receives a first power source ELVDD and a second power source ELVSS, and supplies a voltage to the data line (one of D1 to Dm) coupled thereto by the control of the comparison unit 160.

The timing controller 170 controls the scan driver 110 and the data driver 120.

Figure 2:
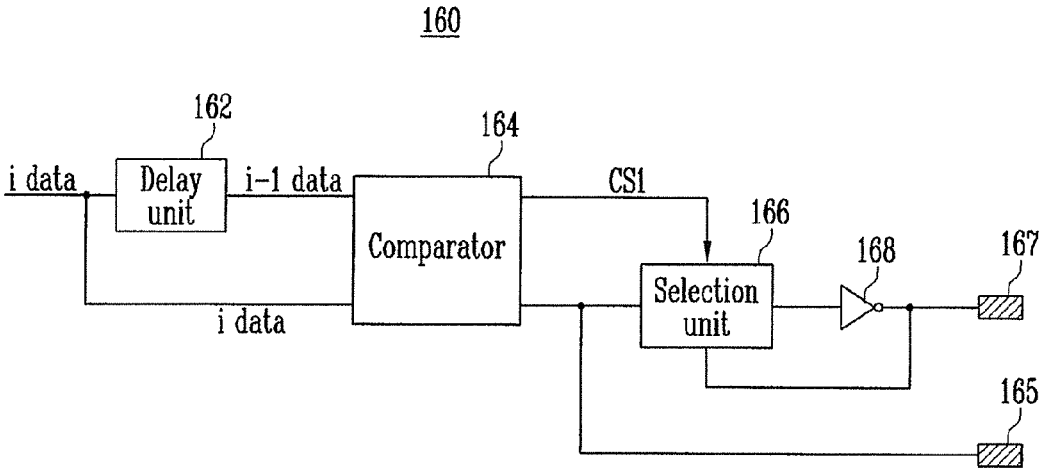
FIG. 2 is a diagram illustrating an embodiment of the comparison unit illustrated in FIG. 1.

FIG. 2 is a diagram illustrating an embodiment of the comparison unit illustrated in FIG. 1.

Referring to FIG. 2, the comparison unit 160 according to one embodiment of the present invention includes a delay unit 162, a comparator 164, a selection unit 166, and an inverter 168.

The comparator 164 receives previous data i−1 data and current data idata to compare the gray level value of the previous data i−1 data with the gray level value of the current data idata. The comparator 164 outputs a first voltage (for example, a low voltage) or a second voltage (for example, a high voltage) to a first output terminal 165 in accordance with the comparison result between the previous data i−1 data and the current data idata.

For example, when it is determined that the current data idata has a higher gray level than the previous data i−1 data, the comparator 164 outputs the first voltage to the first output terminal 165. When it is determined that the current data idata has a lower gray level than the previous data i−1 data, the comparator 164 outputs the second voltage to the first output terminal 165. Further, the comparator 164 outputs the second voltage to the first output terminal 165 and supplies a first control signal CS1 to the selection unit 166 in a period where the same voltage is supplied to the first output terminal 165 and the second output terminal 167. For example, the comparator 164 outputs the second voltage and supplies the first control signal CS1 to the selection unit 166 in a period where it is determined that the current data idata has the same gray level as the previous data i−1 data, that is, in the remaining period excluding (e.g., other than) a partial period in which the scan signals by which the charge units 150 are driven are supplied.

The delay unit 162 delays the data idata supplied from the data driver 120 for one line (1 horizontal period) time to output the data idata. The data delayed by the delay unit 162 for one line time is supplied to the comparator 164 as the previous data i−1 data.

The selection unit 166 selectively couples the first output terminal 165 to the inverter 168 or the second output terminal 167. For example, the selection unit 166 electrically couples the first output terminal 165 to the second output terminal 167 in a period where the first control signal CS1 is supplied and electrically couples the first output terminal 165 to the inverter 168 in a period where the first control signal CS1 is not supplied. When the first output terminal 165 and the inverter 168 are electrically coupled to each other, the second output terminal 167 receives an inverted voltage from the inverter 168. For example, the second voltage is supplied to the second output terminal 167 when the first voltage is supplied to the first output terminal 165 and the first voltage is supplied to the second output terminal 167 when the second voltage is supplied to the first output terminal 165.

Figure 3:
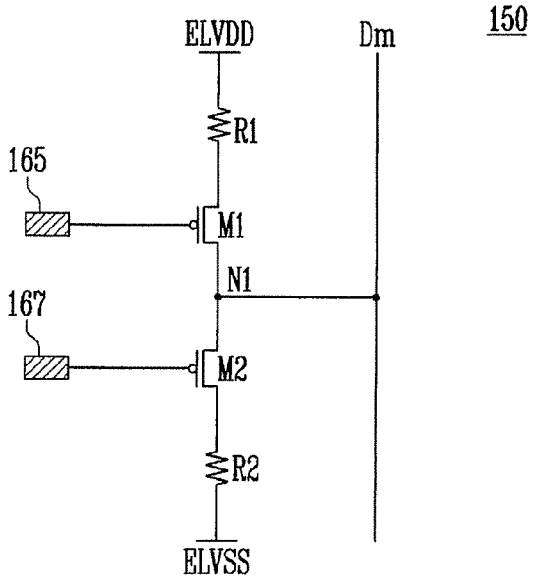
FIG. 3 is a circuit diagram illustrating an embodiment of the charge unit illustrated in FIG. 1.

FIG. 3 is a circuit diagram illustrating an embodiment of the charge unit illustrated in FIG. 1. In FIG. 3, for convenience sake, the charge unit 150 coupled to the mth data line Dm will be illustrated.

Referring to FIG. 3, the charge unit 150 according to one embodiment of the present invention includes a first resistor R1 serially coupled between the first power source ELVDD and the second power source ELVSS, a first transistor M1, a second transistor M2, and a second resistor R2. A first node N1 between the first transistor M1 and the second transistor M2 is electrically coupled to the data line Dm.

The gate electrode of the first transistor M1 is coupled to the first output terminal 165. The first transistor M1 is turned on when the first voltage (e.g., a low voltage) is supplied to the first output terminal 165 to electrically couple the first node N1 and the first resistor R1 to each other.

The gate electrode of the second transistor M2 is coupled to the second output terminal 167. The second transistor M2 is turned on when the first voltage (e.g., a low voltage) is supplied to the second output terminal 167 to electrically couple the first node N1 and the second resistor R2 to each other.

The first resistor R1 prevents current from rapidly flowing to the data line Dm when the first power source ELVDD and the data line Dm are electrically coupled to each other. For example, if the first resistor R1 were removed, because the voltage of the data line Dm would rapidly increase to the voltage of the first power source ELVDD, the voltage of the data line Dm may be set as a higher voltage than that of an actually desired data signal.

The second resistor R2 prevents current from rapidly flowing to the second power source ELVSS when the second power source ELVSS and the data line Dm are electrically coupled to each other. For example, if the second resistor R2 were removed, because the voltage of the data line Dm would rapidly decrease to the voltage of the second power source ELVSS, the voltage of the data line Dm may be set as a lower voltage than that of an actually desired data signal. According to embodiments of the present invention, the resistance values of the first resistor R1 and the second resistor R2 may be experimentally set in consideration of the resolution and size of a panel and the turn on times of the first and second transistors M1 and M2.

Figure 4:
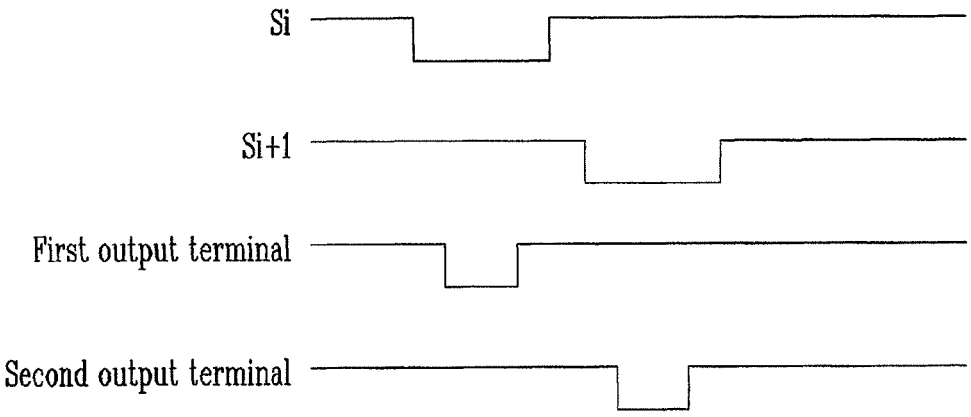
FIG. 4 is a diagram illustrating supply timings of a first voltage and a second voltage corresponding to scan signals.

FIG. 4 is a diagram illustrating the supply timings of a first voltage and a second voltage corresponding to scan signals.

When operation processes are described with reference to FIGS. 1 to 4, first, the comparison unit 160 compares previous data with current data and controls the voltage supplied to the first and second output terminals 165 and 167 in accordance with the comparison result. For example, when the current data has a higher gray level than the previous data, the comparison unit 160 outputs the first voltage to the first output terminal 165. At this time, the second voltage is output to the second output terminal 167 via the inverter 168.

Figure 5A:
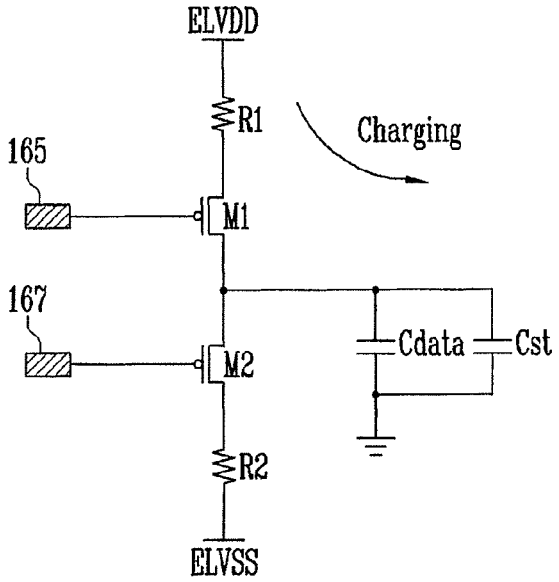
FIGS. 5A and 5B are diagrams illustrating operation processes of the charge unit corresponding to the voltage supply of FIG. 4.

The first voltage output to the first output terminal 165 is supplied in a partial period of the period in which a scan signal is supplied to the scan line Si. When the first voltage is supplied to the first output terminal 165, the first transistor M1 of the charge units 150 coupled to the comparison unit 160 is turned on. Since the scan signal is supplied to the scan line Si, a data signal is supplied to the data line Dm. At this time, the data signal and a voltage (e.g., predetermined voltage) corresponding to the first power source ELVDD are applied to the first resistor R1 and the storage capacitor Cst of the pixel 140 that receives the parasitic capacitor Cdata of the data line Dm and the scan signal, is charged by the voltage (e.g., predetermined voltage) as illustrated in FIG. 5A.

Then, the supply of the first voltage to the first output terminal 165 is stopped so that the first transistor M1 is turned off. Therefore, the parasitic capacitor Cdata and the storage capacitor Cst are finally charged by the voltage of the data signal supplied to the data line Dm.

On the other hand, when the current data has a lower gray level than the previous data, the comparison unit 160 supplies the second voltage to the first output terminal 165 and supplies the first voltage to the second output terminal 167.

Figure 5B:
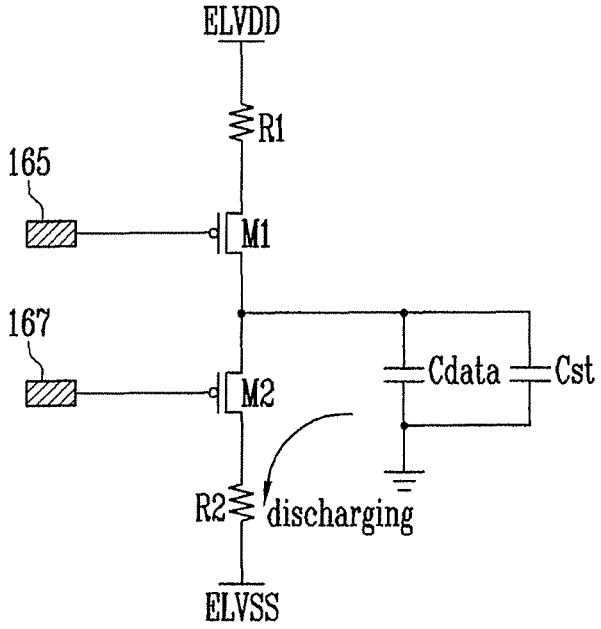

When the first voltage is supplied to the second output terminal 167 in the period where a scan signal is supplied to the scan line Si+1, the second transistor M2 of the charge units 150 coupled to the comparison unit 160 is turned on. Since the scan signal is supplied to the scan line Si+1, the data signal is supplied to the data line Dm. At this time, a data signal and a voltage (e.g., predetermined voltage) corresponding to the second power source ELVSS are applied to the second resistor R2 and the voltage of the storage capacitor Cst of the pixel 140 that receives the parasitic capacitor Cdata of the data line Dm and the scan signal is discharged by the voltage (e.g., predetermined voltage) as illustrated in FIG. 5B.

Then, the supply of the first voltage to the second output terminal 167 is stopped so that the second transistor M2 is turned off. Therefore, the parasitic capacitor Cdata and the storage capacitor Cst are finally charged by the voltage of the data signal supplied to the data line Dm.

On the other hand, the comparison unit 160 supplies the second voltage to the first output terminal 165 and the second output terminal 167 in the period excluding (e.g., other than) a partial period (that is, a period in which the first voltage is supplied) of the period in which the scan signal is supplied. When the second voltage is supplied to the first output terminal 165 and the second output terminal 167, the first transistor M1 and the second transistor M2 included in each of the charge units 150 are set to be in a turn off state.

In addition, the comparison unit 160 supplies the second voltage to the first output terminal 165 and the second output terminal 167 even when the previous data is the same as the current data. Then, in the period where the scan signal is supplied, the first transistor M1 and the second transistor M2 included in each of the charge units 150 are set in the turn off state. Therefore, the parasitic capacitor Cdata and the storage capacitor Cst charge the voltage corresponding to the data signal. Here, since the voltage of the previous data signal is charged in the parasitic capacitor Cdata, that is, since the same voltage as the current data signal is charged, the storage capacitor Cst may be stably charged within a short time.

Figure 6:
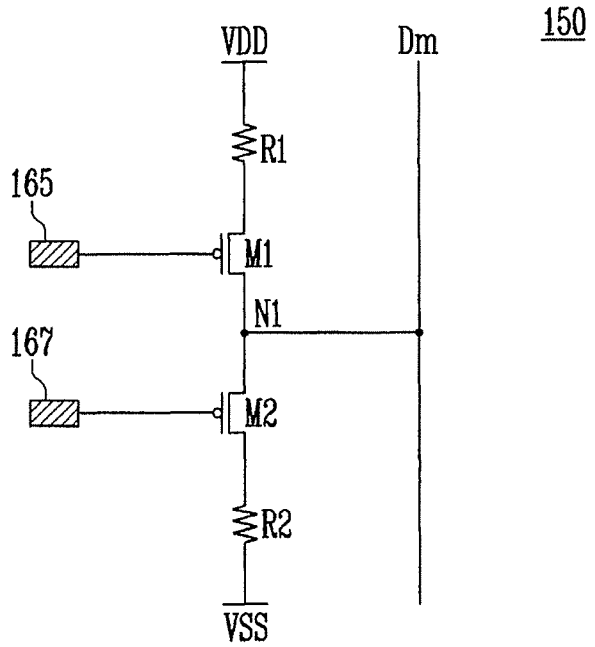
FIG. 6 is a circuit diagram illustrating a charge unit according to another embodiment of the present invention.

FIG. 6 is a circuit diagram illustrating a charge unit according to another embodiment of the present invention. When FIG. 6 is described, detailed description of the same structure as FIG. 3 may be omitted.

Referring to FIG. 6, the first resistor R1 is coupled to a third power source VDD and the second resistor R2 is coupled to a fourth power source VSS. Here, the third power source VDD is set as a higher voltage than the data signal and the fourth power source VSS is set as a lower voltage than the data signal.

That is, the charge unit 150 according to another embodiment of the present invention supplies a voltage to the data line Dm using additional power sources VDD and VSS other than the first power source ELVDD and the second power source ELVSS. Here, the third power source VDD and the fourth power source VSS may be selected by various voltages supplied to the panel.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

pixels at crossing regions between scan lines and data lines, and configured to control an amount of current supplied from a first power source to a second power source;

a charge unit directly adjacent to a pixel among the pixels and coupled to a same one of the data lines as the pixel;

a scan driver for supplying scan signals to the scan lines;

a data driver for supplying data signals to the data lines in synchronization with the scan signals; and a comparison unit in a corresponding one of a plurality of channels of the data driver, and configured to compare a current data signal of the data signals with a previous data signal of the data signals, and to control coupling between the charge unit and the data line in accordance with a comparison result in a partial period of a period in which a corresponding one of the scan signals is supplied, wherein the charge unit is configured to supply, during the partial period, either a first power voltage or a second power voltage to the same one of the data lines as the pixel when a data signal from among the data signals is applied to the same one of the data lines as the pixel, and the pixel is configured to receive the data signal from among the data signals through the same one of the data lines as the pixel.

2. The organic light emitting display as claimed in claim 1, wherein the comparison unit is configured to compare previous data corresponding the previous data signal with current data corresponding to the current data signal.

3. The organic light emitting display as claimed in claim 2, wherein the comparison unit comprises:

a comparator for comparing the previous data with the current data and for outputting a first voltage or a second voltage to a first output terminal in accordance with the comparison result;

a selection unit coupled to the first output terminal; and an inverter coupled between the selection unit and a second output terminal.

4. The organic light emitting display as claimed in claim 3, wherein the comparator is configured to supply a first control signal to the selection unit in a period where a same voltage is supplied to the first output terminal and the second output terminal.

5. The organic light emitting display as claimed in claim 4, wherein the selection unit is configured to electrically couple the first output terminal to the second output terminal when the first control signal is supplied, and to electrically couple the first output terminal to the inverter when the first control signal is not supplied.

6. The organic light emitting display as claimed in claim 4, wherein the comparator is configured to generate the first control signal in a remaining period other than the partial period and when the previous data is the same as the current data.

7. The organic light emitting display as claimed in claim 3, wherein the comparator is configured to output the first voltage to the first output terminal when the current data has a higher gray level than the previous data and to output the second voltage to the first output terminal when the current data is the same as the previous data or has a lower gray level than the previous data.

8. The organic light emitting display as claimed in claim 3, wherein the first voltage is supplied to the first output terminal or the second output terminal in the partial period.

9. The organic light emitting display as claimed in claim 3, wherein the comparison unit further comprises a delay unit for delaying the current data by one horizontal period to supply the delayed current data to the comparator as the previous data.

10. The organic light emitting display as claimed in claim 3, wherein the charge unit comprises a first resistor, a first transistor, a second transistor, and a second resistor serially coupled between a third power source configured to supply the first power voltage and a fourth power source configured to supply the second power voltage that has a lower voltage level than the first power voltage, and wherein a common terminal of the first transistor and the second transistor is coupled to a corresponding one of the data lines.

11. The organic light emitting display as claimed in claim 10, wherein the first transistor is coupled to the first output terminal to be turned on when the first voltage is supplied and is turned off when the second voltage is supplied, and wherein the second transistor is coupled to the second output terminal to be turned on when the first voltage is supplied and is turned off when the second voltage is supplied.

12. The organic light emitting display as claimed in claim 10, wherein the first power voltage has a higher voltage level than the data signal, and wherein the second power voltage has a lower voltage level than the data signal.

13. The organic light emitting display as claimed in claim 10, wherein the first power voltage has a same voltage level as the first power source, and wherein the second power voltage has a same voltage level as the second power source.

14. A method of driving an organic light emitting display, comprising:

sequentially supplying scan signals to scan lines;

supplying data signals to data lines in synchronization with the scan signals;

comparing previous data corresponding to a previous data signal supplied to a corresponding one of the data lines from among the data signals, with current data corresponding to a current data signal supplied to the corresponding one of the data lines from among the data signals; and controlling coupling between each of the data lines and a first power source or a second power source lower than the first power source in a partial period of a period in which a corresponding one of the scan signals is supplied using one of a plurality of charge units coupled to a respective one of the data lines in accordance with the comparison result, wherein the one of the plurality of charge units supply, during the partial period, either a first voltage or a second voltage to the respective one of the data lines when the data signal is supplied to the respective one of the data lines, each respective one of the data lines being coupled to directly adjacent pixels to supply the data signals to the directly adjacent pixels.

15. The method as claimed in claim 14, wherein the first power source has a higher voltage level than the data signal, and wherein the second power source has a lower voltage level than the data signal.

16. The method as claimed in claim 14, wherein the first power source is coupled to a corresponding one of the data lines when the current data has a higher gray level value than the previous data, and wherein the second power source is coupled to the corresponding one of the data lines when the current data has a lower gray level value than the previous data.

17. The method as claimed in claim 14, wherein the first power source and the second power source are not coupled to the data line when the current data is the same as the previous data.

* * * * *